US009670048B2

(12) United States Patent
Vandekerckhove et al.

(10) Patent No.: US 9,670,048 B2
(45) Date of Patent: Jun. 6, 2017

(54) DISPENSING APPLIANCE PROVIDED WITH A REMOVABLE DISPENSING CARTRIDGE

(75) Inventors: Stijn Vandekerckhove, Brussels (BE); Daniel Peirsman, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 13/882,499

(22) PCT Filed: Oct. 28, 2011

(86) PCT No.: PCT/EP2011/069037

§ 371 (c)(1),
(2), (4) Date: May 2, 2013

(87) PCT Pub. No.: WO2012/056019

PCT Pub. Date: May 3, 2012

(65) Prior Publication Data

US 2013/0214011 A1 Aug. 22, 2013

(30) Foreign Application Priority Data

Oct. 29, 2010 (EP) ..... 10189473

(51) Int. Cl.
*B67D 7/06* (2010.01)
*B67D 1/00* (2006.01)
*B67D 1/08* (2006.01)

(52) U.S. Cl.
CPC ..... *B67D 1/0042* (2013.01); *B67D 1/0829* (2013.01)

(58) Field of Classification Search
CPC .... B67D 1/008; B67D 1/0829; B67D 1/0831; B67D 1/0839; B67D 1/0841;
(Continued)

(56) References Cited

U.S. PATENT DOCUMENTS 4,186,848 A 2/1980 Walter
5,022,565 A * 6/1991 Sturman ..... B67D 1/0412 222/396

(Continued)

FOREIGN PATENT DOCUMENTS

DE 39 20 348 12/1989
EP 1 647 499 4/2006

(Continued)

*Primary Examiner* — Frederick C Nicolas
*Assistant Examiner* — Bob Zadeh
(74) *Attorney, Agent, or Firm* — Levy & Grandinetti

(57) ABSTRACT

A dispensing appliance allowing the loading of a container together with a dispensing tube is disclosed. After loading the container into the holding portion of the appliance, a dispensing cartridge is engaged into a receiving system provided in the dispensing portion of the appliance, which is movable with respect to the holding portion from a first loading position to a second dispensing position. The cartridge partially encases a dispensing tube with both inlet and outlet ends protruding out of first and second sides of the cartridge, such that the outlet portion of the dispensing tube is flexible. Upon engaging the cartridge into the receiving system, the outlet portion is engaged into a pinch valve while the inlet points towards the dispensing opening of the container. The dispensing tube inlet is introduced into the dispensing opening upon moving the dispensing portion of the appliance to its second dispensing position.

20 Claims, 3 Drawing Sheets

(58) Field of Classification Search
CPC .. B67D 1/0842; B67D 1/0844; B67D 1/0849; B67D 2001/0092; B67D 2001/0098; B67D 3/041; B67D 3/042
USPC ..... 222/1, 212, 380, 394, 396, 399, 400.7, 222/402.13, 402.18, 501, 504–506, 559, 222/562, 564
See application file for complete search history.

(56) References Cited

U.S. PATENT DOCUMENTS

| | | | | |
|---|---|---|---|---|
| 5,110,014 | A * | 5/1992 | Doundoulakis | B67D 1/0412 222/396 |
| 5,251,787 | A | 10/1993 | Simson | |
| 5,499,758 | A | 3/1996 | McCann et al. | |
| 5,979,713 | A | 11/1999 | Grill | |
| 6,386,403 | B2 * | 5/2002 | Parsons et al. | 222/399 |
| 6,454,131 | B1 | 9/2002 | Van Der Meer et al. | |
| 7,178,699 | B2 | 2/2007 | Spray et al. | |
| 7,806,299 | B2 * | 10/2010 | Wauters et al. | 222/129.1 |
| 8,079,496 | B2 * | 12/2011 | Pakkert et al. | 222/146.6 |
| 8,678,247 | B2 * | 3/2014 | Haskayne | B67D 1/1411 137/170.1 |
| 9,221,666 | B2 * | 12/2015 | Vandekerckhove | B67D 1/0042 |
| 2006/0186136 | A1 * | 8/2006 | Wauters et al. | 222/105 |
| 2009/0108031 | A1 * | 4/2009 | Anderson | 222/394 |
| 2009/0211647 | A1 * | 8/2009 | Anderson et al. | 137/68.23 |
| 2009/0261129 | A1 * | 10/2009 | Vitantonio et al. | 222/394 |
| 2009/0294721 | A1 * | 12/2009 | Wauters et al. | 251/366 |
| 2010/0147874 | A1 * | 6/2010 | Finlay | B67D 1/0456 222/464.1 |
| 2013/0214011 | A1 * | 8/2013 | Vandekerckhove | B67D 1/0829 222/505 |
| 2013/0221034 | A1 * | 8/2013 | Vandekerckhove | B67D 1/0042 222/394 |
| 2013/0341351 | A1 * | 12/2013 | Vandekerckhove | B67D 1/1405 222/95 |
| 2014/0034667 | A1 * | 2/2014 | Peirsman | B67D 1/0406 222/1 |

FOREIGN PATENT DOCUMENTS

| | | |
|---|---|---|
| FR | 2 602 222 | 2/1988 |
| GB | 2 202 836 | 3/1988 |
| GB | 2 237 844 | 11/1989 |
| GB | 2 299 806 | 3/1995 |
| GB | 2 436 828 | 10/2007 |
| WO | WO 90/15774 | 12/1990 |
| WO | WO 2004/050535 | 6/2004 |
| WO | WO 2004/101424 | 11/2004 |
| WO | WO 2005/110912 | 11/2005 |
| WO | WO 2005/113416 | 12/2005 |
| WO | WO 2006/082486 | 8/2006 |
| WO | WO 2008/129018 | 10/2008 |
| WO | WO 2009/142682 | 11/2009 |
| WO | WO 2010/040192 | 4/2010 |
| WO | WO 2010/055057 | 5/2010 |

* cited by examiner

DISPENSING APPLIANCE PROVIDED WITH A REMOVABLE DISPENSING CARTRIDGE

This Application is the U.S. National Phase of International Application Number PCT/EP2011/069037 filed on Oct. 28, 2011, which claims priority to European Application Number 10189473.1 filed on Oct. 29, 2010.

TECHNICAL FIELD

The present invention relates to a dispensing assembly comprising a container containing a fluid mounted in a dispensing appliance, suitable for dispensing the liquid out of the container through a dispensing tube which can be changed with each new container. In particular the dispensing tube is partially encased in a dispensing cartridge that can be received and removably fixed to a receiving system provided in the appliance, thus considerably easing the mounting of a container with a new dispensing tube. The dispensing assembly of the present invention is particularly suitable for dispensing beverages, such as wine, and more particularly carbonated beverages such as beers and sodas.

BACKGROUND OF THE INVENTION

Dispensing containers containing a liquid such as a beverage may require to be mounted into a dispensing appliance for dispensing the liquid contained therein. The dispensing appliance comprises at least one dispensing tube bringing in fluid communication the volume of the container containing the liquid with ambient. This dispensing duct is usually provided with a valve for controlling the flow of liquid out of the container. In order to drive the flow of liquid out of the container, a dispensing appliance usually also comprises means for creating a pressure difference between the interior of the container and ambient to drive the liquid out of the container. Said means may be simply gravity driven, by positioning the inlet of the dispensing duct below the level of liquid like in old oak barrels for wine or in soap dispensers in public washrooms, but more advantageously, they comprise either means for increasing the pressure inside the container or, alternatively, decreasing the pressure outside the container, such as with a pump. If the pressure is being increased outside the container, such dispensing system is referred to herein as a "pressure dispensing" system, whilst a "vacuum dispensing" system refers to systems where the pressure inside the container is decreased. A pump may be used in both pressure and vacuum dispensing systems. For pressure dispensing systems, however, other means can be used such as pressurized gas stored in a pressure cartridge and/or adsorbed on a carrier. Said means for storing pressurized gas may be provided either in the container or in the appliance. If a source of pressurized gas external to the container is used, the dispensing appliance shall require at least a second, gas tube to be connected to a corresponding aperture in the closure or container body to bring said source in fluid communication with the interior of the container.

The gas connection may serve either to inject pressurized gas into the container to drive the dispensing of liquid ("pressure dispensing" systems), or to allow air into the container to fill the volume of dispensed liquid such as to maintain the pressure relatively constant in the container ("vacuum dispensing" systems). The container may comprise a single wall (although the wall can be a laminate) or may comprise several detachable layers, such as in bag-in-containers and bladder-in-containers. Bag-in-containers, also referred to as bag-in-bottles or bag-in-boxes depending on the geometry of the outer vessel, all terms considered herein as being comprised within the meaning of the term bag-in-container, are a family of liquid dispensing packaging consisting of an outer container comprising an opening to the atmosphere—the mouth—and which contains a collapsible inner bag joined to said container and opening to the atmosphere at the region of said mouth. The liquid is contained in the inner bag. The system must comprise at least one vent fluidly connecting the atmosphere to the region between the inner bag and the outer container in order to control the pressure in said region to squeeze the inner bag and thus dispense the liquid contained therein (cf. e.g., WO2008/129018 and GB8925324). Alternatively, in bladder-in-containers, the liquid is contained in the outer container and the inner bag, generally called a bladder, is either inflated to drive the flow of liquid out of the container, or simply put in fluid connection with atmospheric, in order to balance the pressure inside the container (cf. WO9015774, EP1647499, WO2010055057, U.S. Pat. No. 5,499,758, GB9504284, FR2602222, GB8806378). The advantage of bag-in-containers and bladder-in-containers over single wall containers is that the liquid is never in contact with an external gas. The present invention applies to any type of container provided with a closure comprising at least one aperture and is particularly suitable for pressure driven systems, more particularly for bag-in-containers and bladder-in-containers.

Of course, the connection of each tube with each corresponding aperture can be performed individually and once completed the container connected to all necessary tubing for the dispensing of the liquid contained therein can be positioned into the loading portion of the dispensing appliance. An example of such an assembly of a container and a dispensing appliance is given in WO90/15774, wherein the container is a bladder-in-container. In WO90/15774, a bladder and dispensing stem are provided in a dispensing end of the appliance which acts as a closure and can be fixed to the mouth of the container via a thread. The bladder and stem are therefore first introduced into and fixed to the container via said dispensing end, and thereafter the dispensing end and container are positioned in the housing of the appliance. A similar system can be found in U.S. Pat. No. 5,251,787 with a bag-in-container, wherein a dispensing end of the appliance comprises a dispensing stem to be introduced into the bag containing the liquid. Applying a dispensing end of a dispensing appliance with a stem into a container is quite cumbersome and has the great drawback that the container must be opened before mounting on the appliance. This contact of the liquid with ambient may be critical for the quality of some liquids.

For comfort of use, it is preferred that the container may be mounted onto the dispensing appliance in as few steps as possible, and for sensitive liquids, avoiding any contact between the liquid contained in the container with ambient. The latter can be achieved by providing the dispensing tube and any additional tubing, such as a gas connection, with puncturing means suitable for breaking open a sealed opening. To reduce the number of steps required to mount the container onto the dispensing appliance, one could imagine that the container may be mounted onto the holding portion of an appliance and the dispensing end thereof simply applied on against the closure, with the aim of bringing the interior of the container in fluid communication with a dispensing tube and a gas connection. For obvious reasons, the at least one aperture in the closure is generally sealed prior to use and the sealed aperture must then be broken open to introduce the corresponding tubing in the thus unsealed aperture. Generally, the interface between the appliance tubing and corresponding apertures, once engaged into one another, must be gas tight for pressure and most vacuum dispensing systems to allow pressure to build up.

For hygienic reasons, however, as well as for not mixing different tastes when using containers containing different liquids, the dispensing tube is preferably changed with each new container being mounted onto the appliance. This requirement forces back to the solution of the prior art discussed above comprising the distinct steps of connecting each tube individually to the container, mounting the container with tubing onto the appliance, and bringing the appliance in dispensing configuration. For example, U.S. Pat. No. 6,454,131 discloses a semi automated connecting system for a dispensing appliance associated with a bag-in-container. A first connection (18) of a pump (19) to the space (17) between inner and outer layers of the containers must first be performed individually. Then the tip of a right angle curved dispensing tube (34) is laid onto the sealing membrane of the dispensing aperture of the container. Upon closing the lid (4) by a rotational movement about hinges, and by pressurizing the space (17) the tip of the dispensing tube (34) is forced through the dispending aperture. This still represents too long a sequence of steps before a container can be loaded onto an appliance and the latter be operational for dispensing the liquid contained in the container which is not compatible with today's standards of expectation of the consumers.

Alternatively, a new dispensing tube can be provided in a cartridge further comprising a new dispensing valve. Such cartridge can easily be mounted with each new container mounted in the appliance. Such solutions are disclosed, e.g., in U.S. Pat. No. 5,022,565, U.S. Pat. No. 5,979,713, and WO2009142662. Including a new dispensing valve with each new dispensing tube of course has the disadvantage of increasing the cost of a disposable element of the dispensing appliance which could discourage the consumers.

Dispensing cartridges comprising no valve have been proposed in WO2005110912, WO2006082486, and WO2010040192. The cartridges disclosed therein comprise a flexible portion of the dispensing tube protruding out of the cartridge at one side thereof, the distal end of said flexible portion defining the outlet, whilst the proximal end is engaged in a plastic cartridge, wherein it joins a rigid channel forming a sharp 90 deg angle to jut out of the cartridge to form the dispensing tube inlet which is to enter in fluid communication with the liquid contained in the container. The rather elongated cartridge is to be inserted into the dispensing appliance loaded with a container as follows. First the flexible end is engaged in a pinch valve and inserted into a spout downstream from the valve, with the jutting inlet portion resting on top of the closure of the container. Then, in a second step, the jutting inlet portion of the dispensing tube is to be pushed through an initially sealed dispensing opening disposed in the container to bring the interior of the container in fluid communication with ambient through the dispensing tube. The cartridges disclosed in these documents show two major drawbacks. First, the sharp 90 deg angle formed where the jutting inlet portion meets the cartridge portion of the channel, which is required for allowing to push vigorously the inlet end through the container's opening creates a sharp pressure difference in the liquid which promotes excessive formation of froth in carbonated beverages such as sodas and beer. Second, the flexible tube must first be introduced into the pinch valve system and spout and then manually aligned with the container's opening before actually introducing the dispensing tube inlet into the container's opening. Any misalignment may damage either the dispensing tube or the container's opening or both. Furthermore, the end user does not wish to play around with accurate positioning of the cartridge before the appliance can be used.

It appears that there is still a need in the art for dispensing appliances allowing the easy and yet economical mounting of a new dispensing tube in a dispensing appliance with a new container. The dispensing tube must preferably control froth formation for carbonated beverages.

The present invention solves the problem of providing a solution for quickly and easily mounting a container into a dispensing appliance whilst changing the dispensing tube with each new container. This and other objects of the invention are presented hereinbelow.

SUMMARY OF THE INVENTION

The present invention is defined in the appended independent claims. Preferred embodiments are defined in the dependent claims. In particular, the present invention concerns a dispensing appliance suitable for dispensing a liquid out of a container (1) held in position in a holding portion of the appliance, said container containing a liquid to be dispensed and comprising a mouth closed by a closure comprising at least one dispensing opening, said dispensing appliance comprising a dispensing portion provided with:

(a) a valve system for controlling the flow out of the container and;

(b) a receiving system receiving and removably fixing, (c) a dispensing cartridge partially encasing a dispensing tube forming no sharp angle and comprising an inlet end and an outlet end protruding out of a first and second sides, respectively of said cartridge, wherein at least a portion of said dispensing tube including the outlet is made of a flexible, resilient material, said flexible portion being engaged in the valve system, for controlling the flow of liquid through the dispensing tube, characterized in that, (d) the inlet end of the dispensing tube can be brought in fluid contact with the interior of the container through the dispensing opening of the closure upon moving the dispensing portion with respect to the holding position from a first, loading position to a second, dispensing position.

Preferably the dispensing tube curves in the cartridge such that the longitudinal axes of the inlet and outlet form an angle comprised between 80 and 145 deg. The flexible portion of the dispensing tube is preferably partially encased in the cartridge. With this geometry, the cartridge may be provided with a secondary resilient pinch valve which is biased for compressing and obturating the flexible portion encased in the cartridge when the latter is not engaged in the receiving system and is opened upon introduction of the cartridge into the receiving system. The secondary pinch valve may be provided with a latch (112) which is actuated to open the valve upon engaging the cartridge into the receiving system. Inversely, the receiving system may comprise a pin or a trigger that actuate open the secondary valve when the cartridge is loaded into the receiving system. This secondary valve is useful when the container's opening cannot be sealed back after unsealing, as the container can thus be removed from the appliance with the cartridge still fitted in the dispensing opening which is then sealed by said secondary pinch valve. The cartridge then preferably comprises snap fitting means for fixing the cartridge to the closure upon moving the dispensing portion into its second, dispensing position.

In a preferred embodiment, the dispensing tube comprises a pressure reduction section in the cartridge, said pressure reduction section comprising curves and/or variations in the cross-sectional area of the tube.

The valve system (300) of the dispensing portion (202) is preferably a pinch valve acting upon the flexible portion (10D) of the dispensing tube (10A).

The receiving system is preferably a latch system and the cartridge preferably comprises gripping means for engaging into the receiving system. The receiving system is preferably mounted on at least one guiding rail for ensuring a rectilinear movement of the cartridge upon moving the dispensing portion into its second, dispensing position and an accurate introduction of the dispensing tube inlet into the dispensing opening of the closure.

The present invention also concerns a method for loading a container into a dispensing appliance comprising the following steps:

(a) Providing a dispensing appliance comprising a holding portion and a dispensing portion movable with respect to the holding portion from a first, loading position to a second, dispensing position and bringing the dispensing portion in its first, loading position, (b) loading into the holding portion a container comprising a mouth closed by a closure comprising at least one dispensing opening;

(c) Engaging into a receiving system a dispensing cartridge encasing a central section of a dispensing tube such that a flexible portion of said dispensing tube protruding out of a first side of said cartridge is engaged into a valve system provided in the dispensing portion, (d) By moving the dispensing portion from its first, loading position to its second, dispensing position, introducing an inlet end of the dispensing tube protruding out of a second side of the cartridge into the dispensing opening of the container's closure.

A dispensing appliance as defined supra is preferably use to carry out this method. In case of a pressure dispensing system, it is advantageous that by moving the dispensing portion from its first, loading position to its second, dispensing position, a second, gas tube is introduced into a second, gas aperture provided in the closure of the container to bring in fluid communication a source of pressurized gas with the interior of the container. Such system is particularly suitable for loading bag-in-containers. For bag-in-containers it is preferred that the second, gas tube is brought in fluid communication with the interfacial space between the inner and outer layers forming the bag-in-container.

With a dispensing appliance as defined above, a container can be used for dispensing a liquid.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
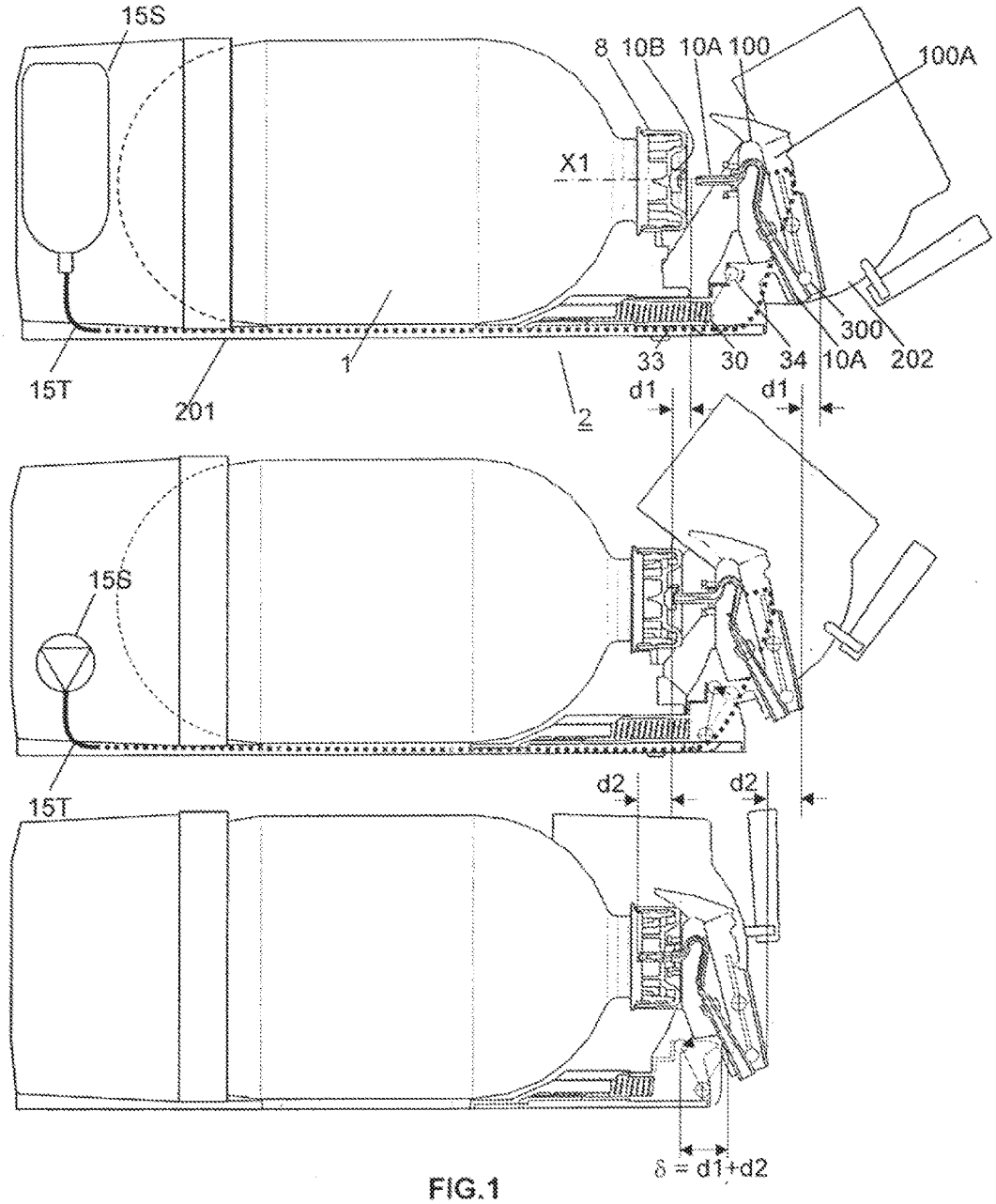
FIG. 1: shows three steps for mounting a container into a dispensing appliance according to the present invention.

As can be seen in FIG. 1, an appliance according to the present invention is suitable for receiving a container (1) and for dispensing a liquid contained in said container through a dispensing tube (10A) which fluidly communicates the volume of the container comprising the liquid with ambient. A container (1) suitable for being mounted onto said appliance shall comprise a body, a mouth, and a closure (8) provided with at least an initially sealed first, dispensing opening (10B) suitable for receiving said dispensing tube (10A). The dispensing appliance (2) of the embodiment illustrated in FIG. 1 comprises:

(a) a holding portion (201) comprising means for holding the container, wherein the container is firmly held in position within the appliance, and (b) a dispensing portion (202) provided with a pinch valve (not shown) for controlling the flow out of the container, and said dispensing portion can be moved with respect to the holding position (201) from a first loading position (cf. FIG. 1(*a*)) for loading the container, to a second, dispensing position (cf. FIG. 1(*c*)) for dispensing the liquid.

Figure 2:
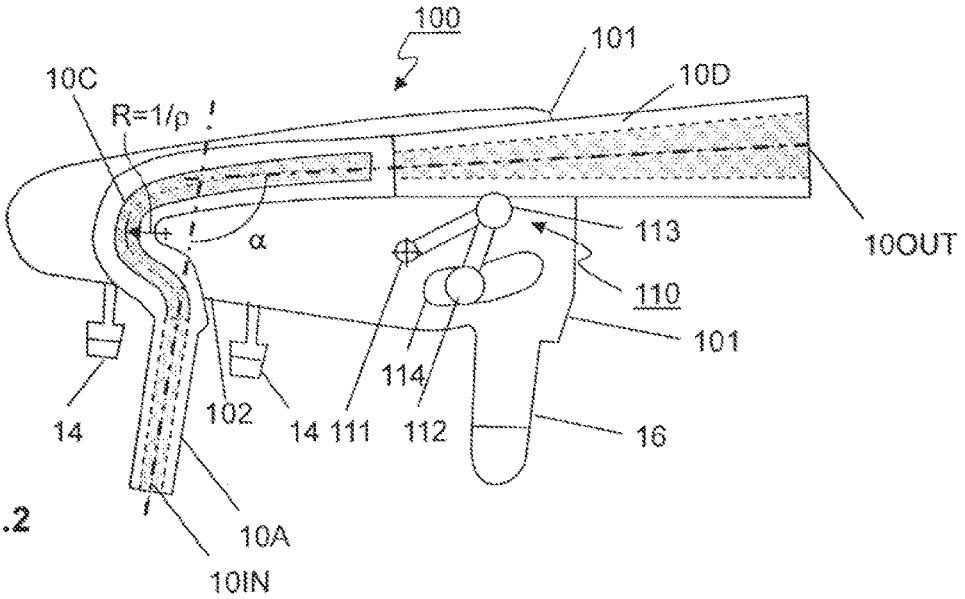
FIG. 2: shows an embodiment of a dispensing cartridge according to the present invention.
Figure 4:
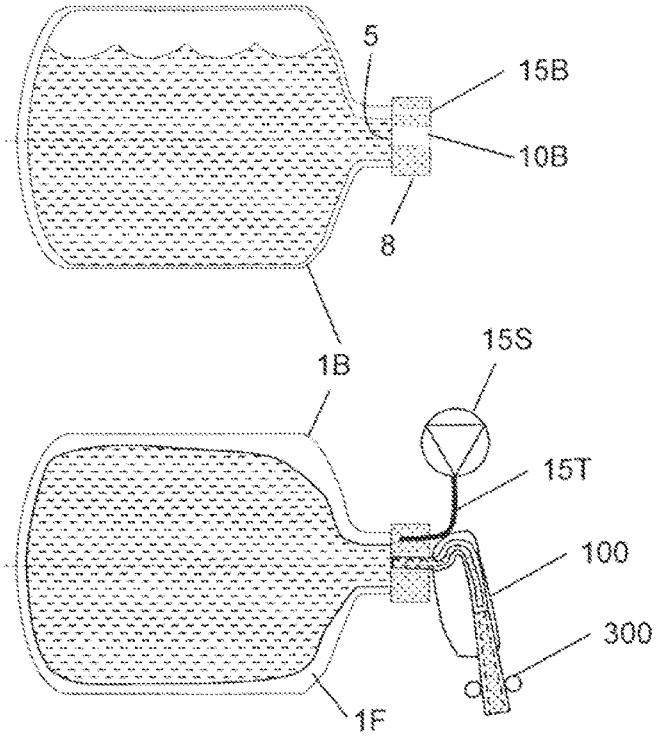
FIG. 4: shows (a) a bag-in-container before use, and (b) the same bag-in-container coupled to a source of pressurized gas and to a dispensing cartridge.

The dispensing portion (202) further comprises a receiving system (100A) for receiving and removably fixing a cartridge of the type represented in FIG. 2. Preferably, the receiving system (100A) consists of a latch system, clicking the cartridge (100) into position. The cartridge (100) according to the present invention, partially encases a dispensing tube (10A) forming no sharp angle and comprising an inlet end (10IN) and an outlet end (10OUT) protruding out of a first and second sides, respectively of said cartridge. At least a portion (10D) of said dispensing tube (10A) including the outlet (10OUT) is made of a flexible resilient material. When the cartridge (100) is engaged into the receiving system; the flexible portion (10D) of the dispensing tube is engaged between the pinching members of the pinch valve system; and the inlet (10IN) points towards the dispensing opening (10B) of the closure (8) of the container, when a container is in place. The latch system (100A) represented in FIG. 1, thus provided with a dispensing cartridge (100) is movingly mounted on rails (33) such that it can travel along said rails. Since the dispensing tube inlet (10IN) points towards the dispensing opening (10B) of the closure of the container, translating the latch system and cartridge along the rails in direction of said closure drives said inlet (10IN) into said dispensing opening (10B). According to the present invention, the translation of the latch system towards the dispensing opening (10B) is driven by moving the dispensing portion (202) from its first, loading position to its second, dispensing position. In particular, in its movement, a contact surface (34) of the dispensing portion (202) literally pushes the latch system and cartridge along the rails (33).

The dispensing portion (202) of the appliance illustrated in FIG. 1 is pivotally connected to the holding portion (201) by at least one hinge (30) to rotationally move from its first, loading position to its second, dispensing position, The advantage of defining a rotational movement upon closing the dispensing portion (202) is that with the torque thus obtained, a higher penetration force of the dispensing tube inlet (10IN) can be obtained. Alternatively, the dispensing unit (202) may be mounted on rails and translated rectilinearly from its first, loading position to its second, dispensing position. In this embodiment, it is clear that guiding rails (33) for guiding the latch system are not required anymore.

The appliance of the present invention is particularly suitable for use with pressure dispensing containers, requiring the pressure inside the container to be raised to drive the flow of liquid out of the container. In some cases, the container comprises means for storing pressurized gas inside the container, such as in a pressure cartridge or adsorbed on a solid support. In such cases, no additional tubing is required. If the source of pressurized gas (15S) is outside the container, however, then a second, gas tube (15T) is needed to bring said source of pressurized gas into fluid communication with the interior of the container through a second opening (15B) in the closure. Unlike the appliance disclosed in U.S. Pat. No. 6,454,131 where the second, gas tube is separately engaged into an opening located near the bottom of the body of the keg whilst the dispensing tube is engaged into an opening in the closure, it is preferred herein to have the gas and dispensing openings (15B, 10B) all provided in the closure, in order to simultaneously engage all tubing into the container with a single move (cf. FIG. 3).

Consequently in a preferred embodiment the dispensing portion (202) further comprises a second, gas tube suitable for engaging into a second opening (15B) of the closure (8) along a rectilinear translation path upon moving the dispensing portion (202) into its second, dispensing position to smoothly engage into said second, gas opening (15B), to bring in fluid communication the interior of the container with a source of pressurized gas.

The dispensing tube inlet (10IN) is preferably oriented coaxially with the longitudinal axis, X1, of the dispensing opening (10A) of the closure (8) when the cartridge (100) and the container are mounted in the appliance. The dispensing tube outlet, on the other hand, shall be oriented downward to pour the liquid such that it can be collected in a vessel, in case of a beverage in a glass. If the container is lying horizontally when held in the dispensing unit, as illustrated in FIG. 1, then the longitudinal axes of the inlet and outlet should form an angle, a, comprised between 85 and 145 deg., preferably between 90 and 135 deg. If, on the other hand, the container is standing upright when held in the dispensing appliance, the dispensing tube (10A) should form an inverted "U" and the longitudinal axes of the inlet and outlet should form an angle comprised between 0 and 45 deg.

In a preferred embodiment, the flexible portion (10D) penetrates at least partially in the cartridge (100). In one embodiment, the whole length of the dispensing tube (10A) is flexible and follows a walled track within the cartridge. In this embodiment, the inlet (10IN) may comprise a ring inserted at the end of the flexible tube (10A, 10D) and held in place with a flange engaged in the casing of the cartridge (100). Said ring should be sufficiently hard and sharp to unseal the dispensing opening (10A) upon introduction of the dispensing tube therein. In another embodiment, the inlet portion (10IN) jutting out of the cartridge is made of rigid plastic, the dispensing bore continuing in the cartridge partially as a moulded channel. At some point in the cartridge, it is preferred that the flexible portion (10D) connects with the rigid channel and protrudes out of the cartridge. In this embodiment, the rigid channel may comprise a pressure reduction section (10C) in the cartridge, said pressure reduction section (10C) comprising curves and/or variations in the cross-sectional area of the tube, but any sharp angle is to be avoided to prevent excessive formation of froth in carbonated beverages such as sodas and beer. A curved "C", "?", or "S" shaped channel contributes to a smooth pressure reduction of the liquid pressurized in the container at a pressure of the order of 1-1.5 bar over atmospheric before it reaches ambient in a rather short distance (=length of the dispensing tube) imposed by the size of compact home beverage appliances. A dispensing tube (10A) is considered to have a sharp angle if said angle is greater than 45 deg and if it has a curvature, $\rho=1/R$, greater than 1.0 $mm^{-1}$, both angle and curvature being measured at the central axis of a tube. Preferably, the dispensing tube (10A) comprises no portion of curvature greater than 0.5 $mm^{-1}$, more preferably none greater than 0.3 $mm^{-1}$, most preferably none greater than 0.2 $mm^{-1}$.

Figure 3:
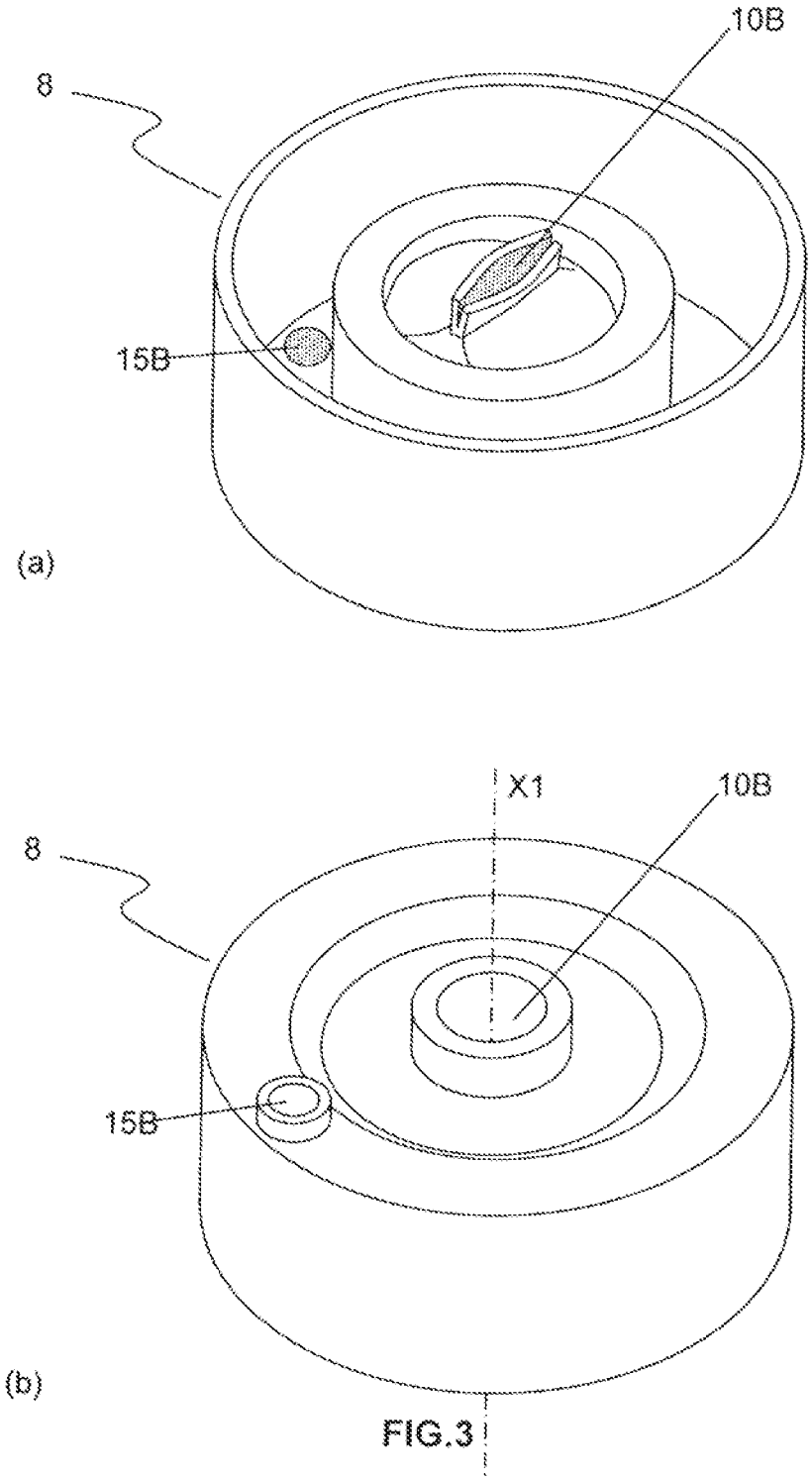
FIG. 3: shows a closure suitable for use in the present invention.

If the flexible portion (10D) extends at least partially in the cartridge, it is possible to provide the cartridge with a secondary pinch valve (110) formed by a squeezing means (113) which is naturally biased so as to squeeze the flexible portion (10D) of the dispensing tube encased in the cartridge (100). Upon insertion of the cartridge (100) into the receiving system (100A), a pin (112) is activated which releases the pressure of the squeezing member (113) from the flexible tube (10D). This embodiment is very advantageous in case the dispensing opening (10B) is permanently unsealed upon introduction therethrough of the dispensing tube inlet (10IN). When removing the container from the appliance, even if the container is not empty, the cartridge remains fixed to the closure, and the opening is sealed by the secondary pinch valve (110). The removed container can thus be stored and mounted again into the appliance when desired. The secondary pinch valve (110) cannot, once engaged in the receiving system, be actuated from the outside of the appliance. In this embodiment, it is preferred if the cartridge comprises snap fitting means (14) for fixing the cartridge to the closure. The cartridge also preferably comprises gripping means (16) for releasably fixing the cartridge to mating gripping means of the receiving system (100A). If, on the other hand, the opening (10A) can be sealed back after removal of the dispensing tube inlet (10IN), if e.g., it comprises a resilient valve as illustrated in FIG. 3, then a secondary pinch valve (110) and snap fitting means (14) are not necessary anymore.

As mentioned supra, the dispensing valve system provided in the dispensing portion (202) is preferably a pinch valve suitable for squeezing a section of the flexural portion (10D) of the dispensing tube. The squeezing member is preferably mechanical, such as one moving member compressing a tube section against a fixed surface, or two opposing moving surfaces. Alternatively, the squeezing member may be hydraulic, but this embodiment is more difficult to implement in a system where a new dispensing tube is to be inserted through the valve at regular intervals. Many examples of pinch valves associated with a beverage dispensing appliance have been disclosed in the art, such as in WO2005/110912. DE3920348, WO2004/050535, WO2009/142662, U.S. Pat. No. 4,186,848, U.S. Pat. No. 5,022,565, US2005072806, and the like; all of which may be applied to the appliance of the present invention. It has been found that dripping after closure of the valve following a pouring session can be greatly decreased by bringing the squeezing members of the pinch valve sufficiently close to the outlet (10OUT).

As illustrated in FIG. 1, the loading of a container (1) into a dispensing appliance can be carried out with the following steps:

(a) providing a dispensing appliance (2) comprising a holding portion (201) and a dispensing portion (202) movable with respect to the holding portion from a first, loading position to a second, dispensing position and bringing the dispensing portion (202) in its first, loading position, (b) loading into the holding portion (201) a container (1) comprising a mouth (5) closed by a closure (8) comprising at least one dispensing opening (10B)

(c) engaging into a receiving system (100A) a dispensing cartridge (100) encasing a central section of a dispensing tube (10A), such that a flexible portion (10D) of said dispensing tube protruding out of a first side (101) of said cartridge is engaged into a valve system (300) provided in the dispensing portion (202), (d) by moving the dispensing portion (202) from its first, loading position to its second, dispensing position, introducing an inlet end (10IN) of the dispensing tube (10A) protruding out of a second side (102) of the cartridge into the dispensing opening (10B) of the container's closure (8).

A dispensing appliance (2) as discussed above is particularly suitable for the above defined method. It is particularly preferred to apply the present method in pressure dispensing systems. In particular, if the pressure source is located out of the container, it is preferred that upon moving the dispensing portion (202) from its first, loading position to its second, dispensing position, a second, gas tube (not shown in the Figures) is introduced into a second, gas aperture (15B) provided in the closure of the container (cf. FIG. 3) to bring in fluid communication a source of pressurized gas with the interior of the container. Bag-in-containers (1B) are particularly suitable for the present method, wherein the second, gas tube is brought in fluid communication through the second gas opening (15B) of the closure with the interfacial space (1F) between the inner and outer layers forming the bag-in-container.

The dispensing assembly obtained as described above comprises a dispensing appliance (2) according to the present invention with a dispensing cartridge (100) and with a container (1) mounted in the holding portion (201) of the dispensing appliance. It is advantageous in that it is very easy to load a new container (1), to change the dispensing tube (10A), and to set the dispensing assembly ready for use in a very few and simple to apply moves. Furthermore, the cost of disposable elements thereof is maintained low. Particularly preferred dispensing assemblies are home appliances for carbonated beverages, such as sodas and beer.

The invention claimed is:

1. A dispensing appliance suitable for dispensing a liquid out of a container held in position in a holding portion of the appliance, said container containing a liquid to be dispensed and comprising a mouth closed by an initially sealed closure comprising a seal and at least one dispensing opening upon breaking open the seal, said dispensing appliance comprising a dispensing portion provided with:

(a) a valve system for controlling a flow out of the container and;

(b) a receiving system receiving and removably fixing a dispensing cartridge, (c) said dispensing cartridge partially encasing a dispensing tube forming no sharp angle, wherein the sharp angle is defined as an angle forming a curvature, $\rho=1/R$, greater than 1.0 $mm^{-1}$, measured at the central axis of the dispensing tube, and comprising an inlet end and an outlet end protruding out of a first and second sides, respectively of said cartridge, wherein at least a portion of said dispensing tube including the outlet end is made of a flexible, resilient material forming a flexible portion, said flexible portion being engaged in the valve system, for controlling the flow of said liquid through the dispensing tube, characterized in that, (d) neither the valve system nor the closure is part of the dispensing cartridge, and (e) the inlet end of the dispensing tube can be brought in fluid contact with an interior of the container through the dispensing opening of the closure upon moving the dispensing portion with respect to the holding portion from a loading position to a dispensing position.

2. The dispensing appliance according to claim 1, wherein longitudinal axes of an inlet and an outlet of the dispensing tube form an angle, $\alpha$, comprised between 80 and 145 deg.

3. The dispensing appliance according to claim 2, wherein the flexible portion of the dispensing tube is partially encased in the cartridge which comprises a secondary resilient pinch valve which is biased for compressing and obturating the flexible portion encased in the cartridge when the cartridge is not engaged in the receiving system and is opened upon introduction of the cartridge into the receiving system.

4. The dispensing appliance according to claim 3, wherein the cartridge comprises gripping means for engaging into the receiving system and/or the receiving system consists of a latch system.

5. The dispensing appliance according to claim 4, wherein the cartridge comprises snap fitting means for fixing the cartridge to the closure upon moving the dispensing portion into the dispensing position.

6. The dispensing appliance according to claim 5, wherein the dispensing tube comprises a pressure reduction section in the cartridge, said pressure reduction section comprising curves and/or variations in a cross-sectional area of the tube.

7. The dispensing appliance according to claim 6, wherein the valve system of the dispensing portion is a pinch valve.

8. The dispensing appliance according to claim 1, wherein the receiving system is mounted on at least one guiding rail for ensuring a rectilinear movement of the cartridge upon moving the dispensing portion into the dispensing position and introduction of the dispensing tube inlet into the dispensing opening of the closure.

9. The dispensing appliance according to claim 1, wherein the flexible portion of the dispensing tube is partially encased in the cartridge which comprises a secondary resilient pinch valve which is biased for compressing and obturating the flexible portion encased in the cartridge when the cartridge is not engaged in the receiving system and is opened upon introduction of the cartridge into the receiving system.

10. The dispensing appliance according to claim 1, wherein the cartridge comprises gripping means for engaging into the receiving system and/or the receiving system consists of a latch system.

11. The dispensing appliance according to claim 1 wherein the cartridge comprises snap fitting means for fixing the cartridge to the closure upon moving the dispensing portion into the dispensing position.

12. The dispensing appliance according to claim 1 wherein the dispensing tube comprises a pressure reduction section in the cartridge, said pressure reduction section comprising curves and/or variations in a cross-sectional area of the tube.

13. A method for loading a container into a dispensing appliance comprising the following steps:

(a) providing a dispensing appliance comprising a holding portion and a dispensing portion movable with respect to the holding portion from a loading position to a dispensing position and bringing the dispensing portion in the loading position, (b) loading into the holding portion the container comprising a mouth closed by an initially sealed closure comprising a seal and at least one dispensing opening upon breaking open the seal, (c) engaging into a receiving system a dispensing cartridge encasing a central section of a dispensing tube, such that a flexible portion of said dispensing tube protruding out of a first side of said cartridge is engaged into a valve system provided in the dispensing portion, wherein said central section of a dispensing tube forms no sharp angle, wherein the sharp angle is defined as an angle forming a curvature, $\rho=1/R$, greater than 1.0 $mm^{-1}$, measured at the central axis of the dispensing tube, and (d) by moving the dispensing portion from the loading position to the dispensing position, introducing an inlet end of the dispensing tube protruding out of a second side of the cartridge into the dispensing opening of the closure of the container.

14. The method according to claim 13, wherein the dispensing appliance comprises a dispensing portion provided with:

(a) the valve system for controlling a flow out of the container and;

(b) the receiving system receiving and removably fixing the dispensing cartridge, (c) said dispensing cartridge partially encasing the dispensing tube comprising the inlet end and the outlet end protruding out of the first and second sides, respectively of said cartridge, wherein at least a portion of said dispensing tube including the outlet end is made of a flexible, resilient material forming a flexible portion, said flexible portion being engaged in the valve system for controlling the flow of said liquid through the dispensing tube, wherein, (d) the inlet end of the dispensing tube can be brought in fluid contact with an interior of the container through the dispensing opening of the closure upon moving the dispensing portion with respect to the holding position from the loading position to the dispensing position.

15. The method according to claim 14, wherein by moving the dispensing portion from the loading position to the dispensing position, a gas tube is introduced into a gas aperture provided in the closure of the container to bring in fluid communication a source of pressurized gas with the interior of the container.

16. The method according to claim 15, wherein the container is a bag-in-container.

17. The method according to claim 16, wherein the gas tube is brought in fluid communication with an interfacial space between an inner layer and an outer layer forming the bag-in-container.

18. The method according to claim 13, wherein by moving the dispensing portion from the loading position to the dispensing position, a gas tube is introduced into a gas aperture provided in the closure of the container to bring in fluid communication a source of pressurized gas with an interior of the container.

19. The method according to claim 13, wherein the container is a bag-in-container.

20. A method of using a container for dispensing a liquid with an appliance suitable for dispensing said liquid out of the container held in position in a holding portion of the appliance, said container containing said liquid to be dispensed and comprising a mouth closed by an initially sealed closure comprising a seal and at least one dispensing opening upon breaking open the seal said dispensing appliance comprising a dispensing portion provided with:

(a) controlling a flow out of the container by a valve system;

(b) receiving and removably fixing a dispensing cartridge; and (c) dispensing from a dispensing cartridge partially encasing a dispensing tube forming no sharp angle, wherein the sharp angle is defined as an angle forming a curvature, $\rho=1/R$, greater than 1.0 $mm^{-1}$, measured at the central axis of the dispensing tube, and comprising an inlet end and an outlet end protruding out of a first and second sides, respectively of said cartridge, wherein at least a portion of said dispensing tube including the outlet end is made of a flexible, resilient material forming a flexible portion, said flexible portion being engaged in the valve system, for controlling the flow of said liquid through the dispensing tube, wherein the inlet end of the dispensing tube can be brought in fluid contact with an interior of the container through the dispensing opening of the closure upon moving the dispensing portion with respect to the holding position from a loading position to a dispensing position.

* * * * *